US010018962B2

(12) United States Patent
Sue

(10) Patent No.: US 10,018,962 B2
(45) Date of Patent: Jul. 10, 2018

(54) OPTICAL SCANNING DEVICE AND IMAGE FORMING APPARATUS INCLUDING THE SAME

(71) Applicant: KYOCERA Document Solutions Inc., Osaka (JP)

(72) Inventor: Tomohiro Sue, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/602,399

(22) Filed: May 23, 2017

(65) Prior Publication Data

US 2017/0343960 A1 Nov. 30, 2017

(30) Foreign Application Priority Data

May 27, 2016 (JP) ..... 2016-106754

(51) Int. Cl.
*G03G 21/20* (2006.01)
*G03G 15/04* (2006.01)

(52) U.S. Cl.
CPC ..... *G03G 21/206* (2013.01); *G03G 15/04036* (2013.01)

(58) Field of Classification Search
CPC ..... G03G 21/206; G03G 15/04036
See application file for complete search history.

(56) References Cited

U.S. PATENT DOCUMENTS

2003/0188477 A1* 10/2003 Pasternak ..... A01G 9/246 47/17
2007/0024690 A1* 2/2007 Sowa ..... G03G 15/0258 347/129
2008/0025750 A1* 1/2008 Yamazaki ..... G02B 26/121 399/92
2010/0033787 A1* 2/2010 Serizawa ..... G03G 15/04036 359/197.1
2013/0016992 A1* 1/2013 Watanabe ..... G03G 15/04036 399/92
2014/0119768 A1* 5/2014 Yuki ..... G03G 21/1666 399/98

FOREIGN PATENT DOCUMENTS

JP 2015-199278 11/2015

* cited by examiner

*Primary Examiner* — Francis C Gray
(74) *Attorney, Agent, or Firm* — Wenderoth, Lind & Ponack, L.L.P.

(57) ABSTRACT

An optical scanning device includes a cooling air passage that passes through inside of the housing, a blowing part that takes in air outside of the housing from a first end portion of the cooling air passage and allowing the air to be discharged from a second side portion, the first end portion facing the second side portion, a foreign matter falling concave part provided adjacent to the transparent cover in the predetermined direction such that an accumulated foreign matter is fallen at a front side in a progress direction of the cleaning member when the cleaning member reaches each moving end of the reciprocal movement path, and a communication passage that allows the foreign matter falling concave part and the cooling air passage to communicate with each other.

10 Claims, 10 Drawing Sheets

OPTICAL SCANNING DEVICE AND IMAGE FORMING APPARATUS INCLUDING THE SAME

CROSS-REFERENCE TO RELATED APPLICATION

This application is based upon and claims the benefit of priority from Japanese Patent Application No. 2016-106754 filed on May 27, 2016, the entire contents of which are incorporated herein by reference.

BACKGROUND

The technology of the present disclosure relates to an optical scanning device and an image forming apparatus including the same.

Conventionally, an image forming apparatus employing an electrophotographic system such as a copy machine and a printer includes an optical scanning device that emits lights for forming an electrostatic latent image on a photoreceptor, and a developing device for developing the electrostatic latent image formed on the photoreceptor as a toner image.

The optical scanning device has a housing that receives a polygon mirror, an image forming lens and the like. The housing is formed with light emitting ports that emit lights. The light emitting port includes an opening extending in a predetermined direction. The light emitting port is closed by a transparent cover.

When dirt, dust and the like due to toner and the like are attached to the surface of the transparent cover, there is a problem that the optical characteristics of the optical scanning device are deteriorated and thus image failure occurs. In this regard, there has been proposed a cleaning mechanism that regularly cleans the surface of the transparent cover.

The cleaning mechanism has a screw shaft extending in the same direction as the extension direction of the transparent cover, and a holding member that holds a cleaning member in engagement with the screw shaft. The screw shaft is connected to a motor via a gear train so as to be able to transmit power.

The screw shaft is rotated forward and backward by the motor, so that the holding member reciprocally moves along the screw shaft. By so doing, the cleaning member reciprocally moves while abutting the surface of the transparent cover, so that the surface of the transparent cover is cleaned by the cleaning member.

SUMMARY

An optical scanning device according to one aspect of the present disclosure includes a housing, a transparent cover, a screw shaft, a holding member, and a cleaning member. The housing has light emitting ports extending in a predetermined direction. The transparent cover extends in the predetermined direction to close the light emitting ports. The screw shaft is a freely rotatable shaft arranged along the transparent cover and formed on a peripheral surface thereof with a spiral groove. The holding member is engaged with the screw shaft and moves along a predetermined reciprocal movement path according to rotation of the screw shaft. The cleaning member is held by the holing member and cleans the surface of the transparent cover while moving in the aforementioned predetermined direction according to reciprocal movement of the holing member.

The aforementioned optical scanning device includes a cooling air passage, a blowing part, a foreign matter falling concave part, and a communication passage. The cooling air passage passes through inside of the housing. The blowing part takes in air outside of the housing from a first end portion of the cooling air passage and allows the air to be discharged from a second side portion, the first end portion facing the second side portion. The foreign matter falling concave part is provided adjacent to the transparent cover in the aforementioned predetermined direction such that accumulated foreign matters are fallen at a front side in a progress direction of the cleaning member when the aforementioned cleaning member has reached each moving end of the aforementioned reciprocal movement path. The communication passage allows the foreign matter falling concave part and the cooling air passage to communicate with each other.

DETAILED DESCRIPTION

Hereinafter, an example of an embodiment will be described in detail on the basis of the drawings. It is noted that the technology of the present disclosure is not limited to the following embodiments.

<<Embodiment>>

Figure 1:
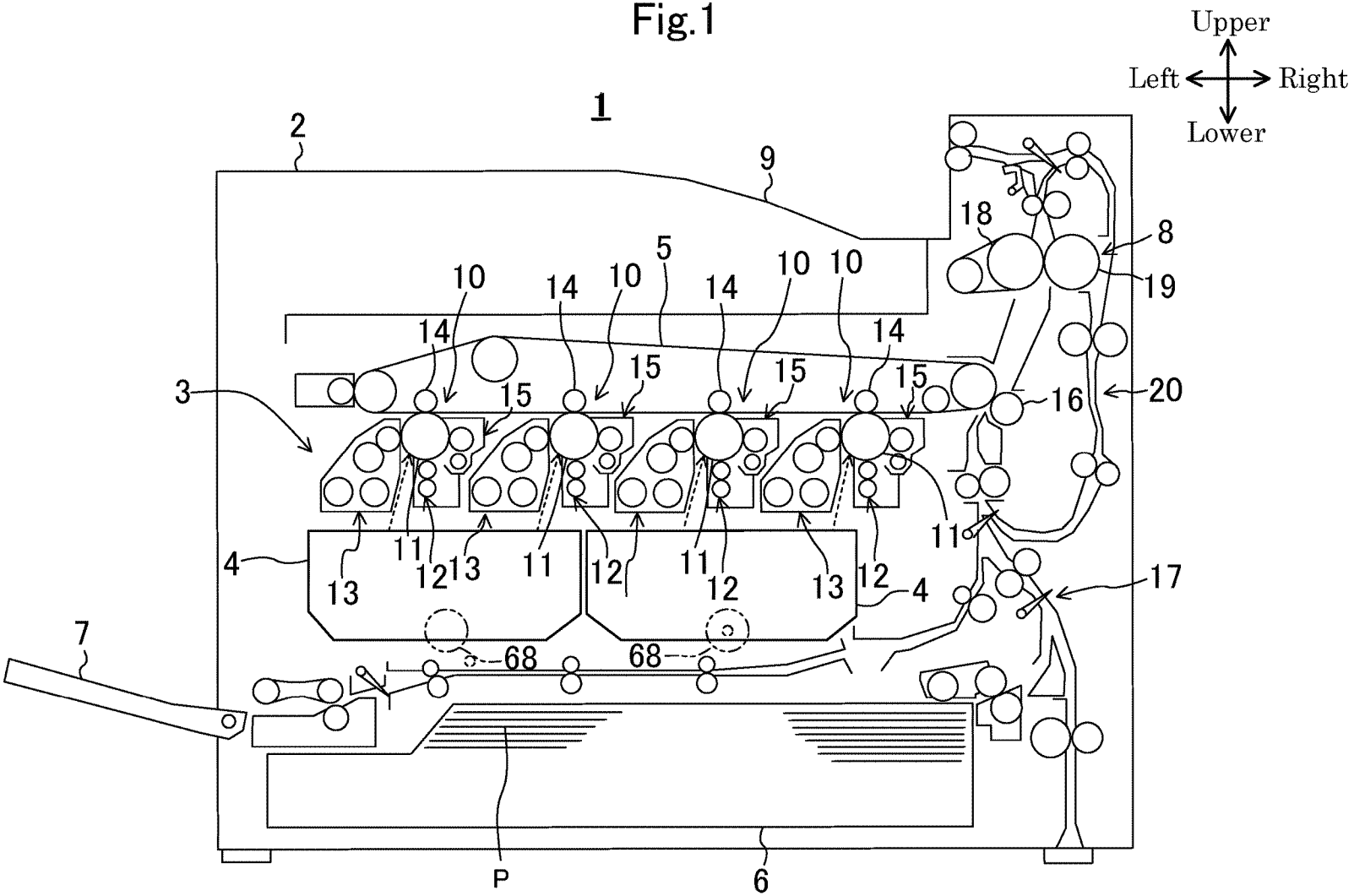
FIG. 1 is an overall view illustrating a schematic configuration of an image forming apparatus provided in an embodiment.

FIG. 1 illustrates a schematic configuration diagram of an image forming apparatus 1 in an embodiment. In the following description, it is assumed that a front side and a rear side indicate a front side and a rear side (a front side and a back side in a direction vertical to the paper surface of FIG. 1) of the image forming apparatus 1, and a left side and a right side indicate a left side and a right side when the image forming apparatus 1 is viewed from the front side.

The image forming apparatus 1 is a tandem type color printer and includes an image forming apparatus body 2 covered by a box-like casing. The image forming apparatus body 2 has an image forming unit 3 therein. The image forming unit 3 transfers an image to a recording paper P and forms the image on the recording paper P on the basis of image data transmitted from an external device such as a computer subjected to network connection and the like.

Below the image forming unit 3, two optical scanning devices 4 are arranged to emit laser lights, and above the image forming unit 3, a transfer belt 5 is arranged. Below the two optical scanning devices 4, a paper storage unit 6 is arranged to store the recording paper P, and at the left side of the paper storage unit 6, a manual paper feeding unit 7 is arranged. At a right upper side of the transfer belt 5, a fixing unit 8 is arranged to perform a fixing process on the image transferred to and formed on the recording paper P. A reference numeral 9 indicates a paper discharge unit arranged at an upper portion of the image forming apparatus body 2 to discharge the recording paper P subjected to the fixing process in the fixing unit 8.

The image forming unit 3 includes four image forming units 10 arranged in a row along the transfer belt 5. Each of the image forming units 10 has a photosensitive drum 11. Directly under each photosensitive drum 11, a charging device 12 is arranged, and at the left side of each photosensitive drum 11, a developing device 13 is arranged. Directly above each photosensitive drum 11, a primary transfer roller 14 is arranged, and at the right side of each photosensitive drum 11, a cleaning unit 15 is arranged to clean the peripheral surface of the photosensitive drum 11.

The peripheral surface of each photosensitive drum 11 is uniformly charged by the charging device 12, and laser lights based on predetermined image data are irradiated to the charged peripheral surface of each photosensitive drum 11 from the two optical scanning devices 4, so that an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the transfer belt 5 by a transfer bias applied to the primary transfer roller 14.

A reference numeral 16 indicates a secondary transfer roller arranged below the fixing unit 8 in the state of abutting the transfer belt 5, wherein the recording paper P conveyed along a paper conveyance path 17 from the paper storage unit 6 or the manual paper feeding unit 7 is interposed between the secondary transfer roller 16 and the transfer belt 5, and the toner images on the transfer belt 5 are transferred to the recording paper P by a transfer bias applied to the secondary transfer roller 16.

The fixing unit 8 includes a heating roller 18 and a pressure roller 19, wherein the recording paper P is interposed by the heating roller 18 and the pressure roller 19 so as to be pressed and heated, so that the toner images, which have been transferred to the recording paper P, are fixed to the recording paper P. The recording paper P subjected to the fixing process is discharged to the paper discharge unit 9. A reference numeral 20 indicates a reversing conveyance path for reversing the recording paper P discharged from the fixing unit 8 at the time of duplex printing.

—Details of Optical Scanning Device—

The two optical scanning devices 4 are arranged in a row in a right and left direction. The left optical scanning device 4 is configured to emit laser lights corresponding to magenta (M) and cyan (C) and the right optical scanning device 4 is configured to emit laser lights corresponding to yellow (Y) and black (K). Since the configurations of the two optical scanning devices 4 are equal to each other, only the configuration of the right optical scanning device 4 will be described below and a description of the left optical scanning device 4 will be omitted.

Figure 2:
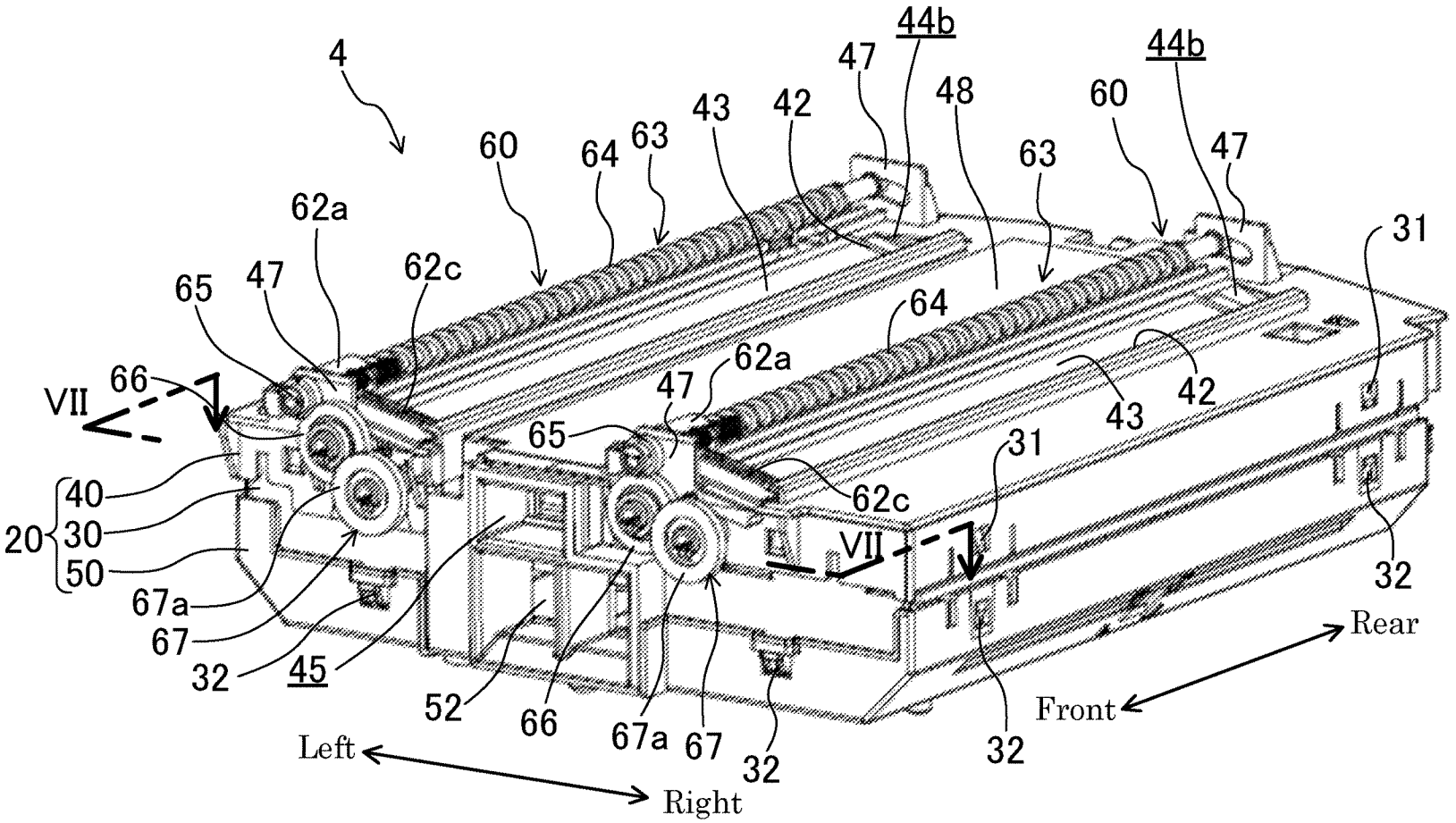
FIG. 2 is a perspective view illustrating an optical scanning device when viewed from a front oblique right side.
Figure 3:
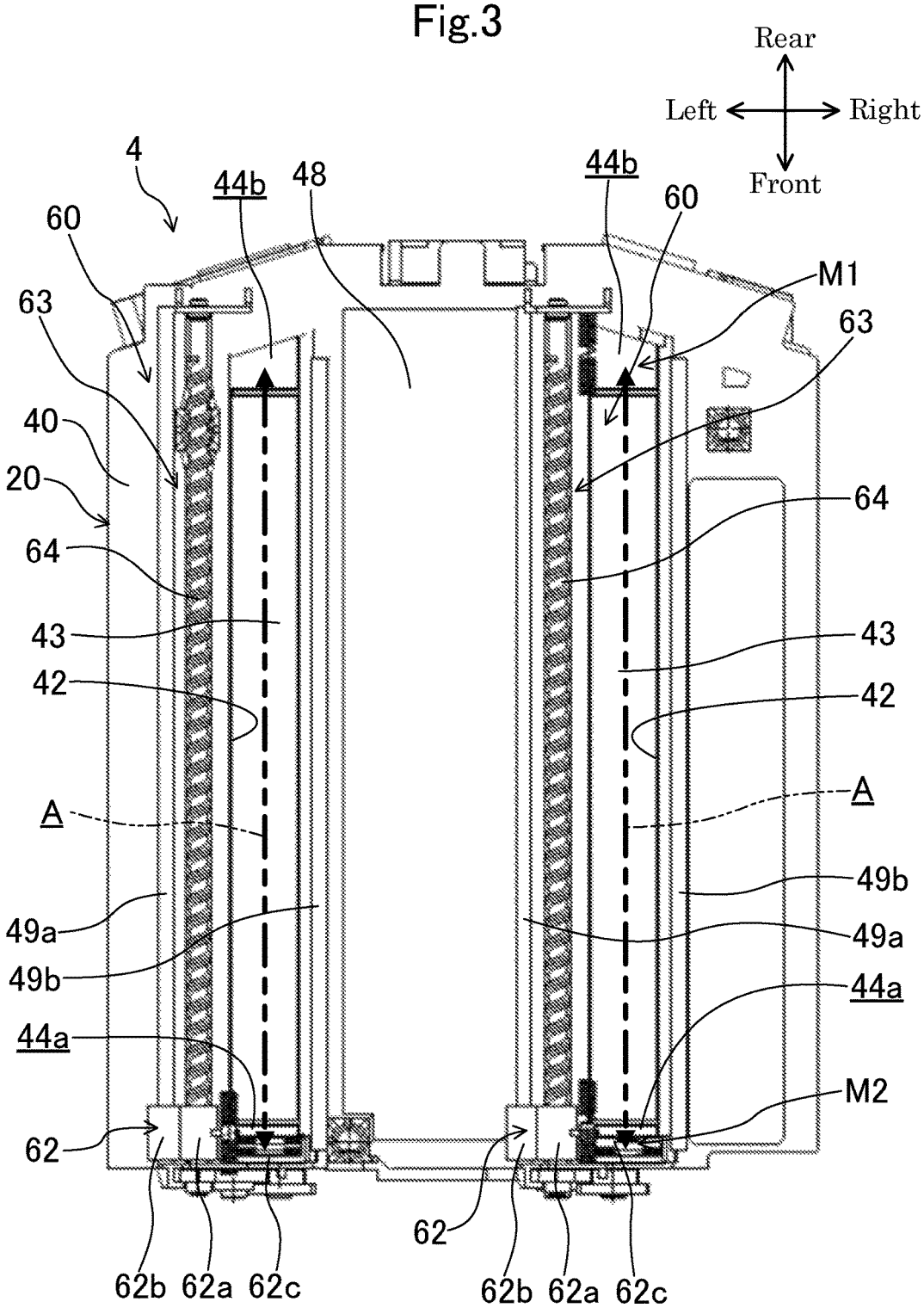
FIG. 3 is a plan view illustrating an optical scanning device when viewed from an upper side.

As illustrated in FIG. 2 and FIG. 3, the optical scanning device 4 includes a resinous optical hosing 20. The optical hosing 20 has a flat sealed box shape. The optical hosing 20 is configured with a housing body 30 having a bottomed box shape and opened upward, an upper lid 40 covering an upper side of the housing body 30, and a lower lid 50 covering a lower side of the housing body 30. The upper lid 40 is formed with a pair of light emitting ports 42 arranged in a right and left direction. Each light emitting port 42 has a rectangular shape extending in a front and rear direction (a predetermined direction), and is covered by a glass cover 43 serving as a transparent cover. At positions of the upper lid 40, which are adjacent to the front side and the rear side of each glass cover 43, a front concave part 44*a* and a rear concave part 44*b* are formed to allow foreign matters collected by a cleaning member 61, which will be described later, to fall. The front concave part 44*a* and the rear concave part 44*b* are both opened upward. The front concave part 44*a* and the rear concave part 44*b* correspond to foreign matter falling concave parts.

The housing body 30 receives therein a light source that generates a pair of laser lights corresponding to yellow (Y) and black (K) (or magenta (M) and cyan (C)), a polygon mirror 76 (see FIG. 5) that deflects the laser lights, and an optical element group that allows the deflected laser lights to form an image on the surface of the photosensitive drum 11. The pair of laser lights emitted from the light source are scanned by the polygon mirror 76 in a main scanning direction, the image of the laser lights is formed by the optical element group, and then the laser lights are emitted from the light emitting ports 42 formed in the upper lid 40 toward the photosensitive drums 11 corresponding to each color.

The upper lid 40 is provided on the upper surface thereof with a pair of cleaning mechanisms 60 for automatically cleaning the glass covers 43. Each cleaning mechanism 60 has a cleaning member 61 for cleaning the glass cover 43, a holding member 62 for holding the cleaning member 61 (see FIG. 4), and a movement mechanism 63 for allowing the holding member 62 to reciprocally move in the front and rear direction along the glass cover 43. The movement mechanism 63 has a screw shaft 64 extending in the front and rear direction along the glass cover 43. The screw shaft 64 is formed on the outer peripheral surface thereof with a spiral groove part, and the holding member 62 is supported in engagement with the screw shaft 64.

Figure 4:
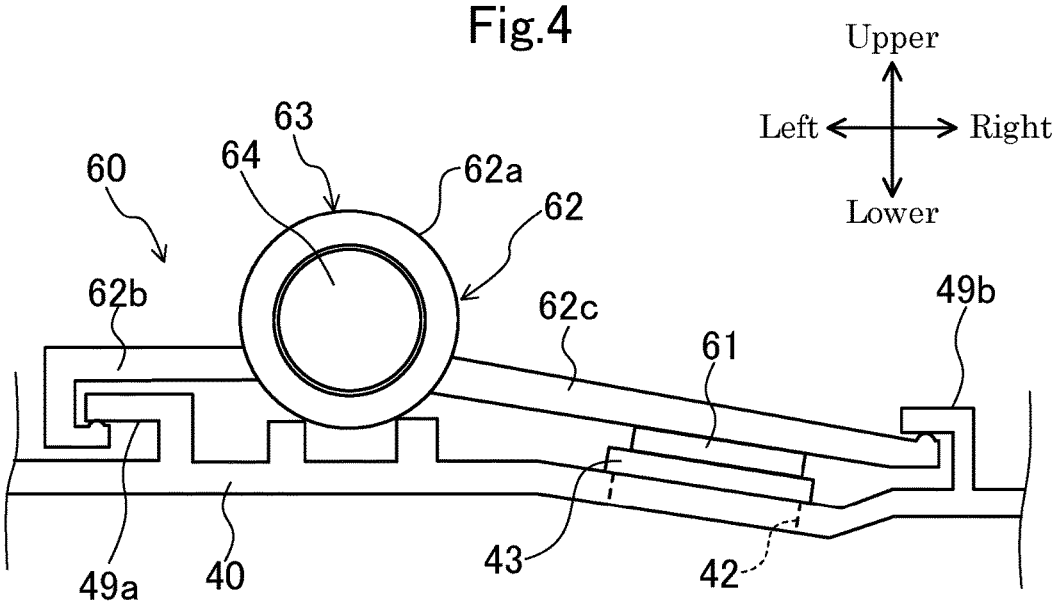
FIG. 4 is a schematic view illustrating a cleaning mechanism when viewed from an axial direction of a screw shaft.

As illustrated in FIG. 4, the cleaning member 61 includes a blade member that abuts the upper surface of the glass cover 43. The blade member, for example, includes an elastic member such as a silicon pad. The holding member 62 has a cylindrical nut part 62*a* fitted to the screw shaft 64, a left arm part 62*b* extending leftward from a left side surface of the nut part 62*a*, and a right arm part 62*c* extending rightward from a right side surface of the nut part 62*a*. A distal end portion of the left arm part 62*b* is engaged with a left rail part 49*a* having an L sectional shape and protruding from the upper surface of the upper lid 40. A distal end portion of the right arm part 62*c* is engaged with a right rail part 49*b* having an L sectional shape and protruding from the upper surface of the upper lid 40. By so doing, the holding member 62 is guided by the left and right rail parts 49*a* and 49*b* so as to be movable in the front and rear direction.

Each movement mechanism 63 has a driven gear 65, an idle gear 66, and an input gear 67 in addition to the screw shaft (see FIG. 2). The driven gear 65 is fixed to a front end portion of the screw shaft 64 and is rotated together with the screw shaft 64. The idle gear 66 is meshed with the driven gear 65 from a right oblique lower side. The input gear 67 has a small diameter gear part (not illustrated) and a large diameter gear part 67*a* coaxially arranged. The small diameter gear part of the input gear 67 is meshed with the idle gear 66 from a right oblique lower side. The idle gear 66 and the input gear 67 are rotatably held to the front side surface of the upper lid 40 via shaft members. The large diameter gear part 67*a* of the input gear 67 is meshed with a motor gear when the optical hosing 20 is set at a predetermined position in the image forming apparatus body 2 from an upper side. The motor gear is connected to a motor 68 (illustrated only in FIG. 1) provided in the image forming apparatus body 2 so as to be able to transmit power. The motor 68, for example, may also serve as a motor for driving a paper conveying mechanism in the image forming apparatus body 2.

When the cleaning mechanism 60 operates, the screw shaft 64 is driven both forward and backward by the motor 68. As a consequence, since the screw shaft 64 is rotated together with the driven gear 65, the holding member 62 engaged with and supported to the screw shaft 64 reciprocally moves in the front and rear direction. In this way, the cleaning member 61 held by the holding member 62 reciprocally moves in the front and rear direction while abutting the upper surface of the glass cover 43, so that the upper surface of the glass cover 43 is cleaned.

A reciprocal movement path A (see FIG. 3) of the cleaning member 61 is a linear movement path extending in the front and rear direction, and a rear moving end M1 of the reciprocal movement path A serves as a waiting position in the present embodiment. The waiting position is a position at which the cleaning member 61 having ended a reciprocal operation waits until a subsequent reciprocal operation starts. The waiting position is positioned at an opposite side (a rear side) of a windward side (a front side) of cooling airflow, which will be described later, in the reciprocal movement path A. The waiting position is positioned at an upper side of the rear concave part 44*b* formed at the upper surface portion of the upper lid 40. On the other hand, a front moving end M2 (a moving end opposite to the waiting position) of the reciprocal movement path A is positioned at an upper side of the front concave part 44*a* formed at the upper surface portion of the upper lid 40. The cleaning mechanism 60 operates, so that foreign matters on the glass cover 43, which are collected during the movement of the cleaning member 61 from the waiting position (the rear moving end M1 of the reciprocal movement path A) to the front moving end M2, are fallen in the front concave part 44*a*. On the other hand, foreign matters on the glass cover 43, which are collected during the returning of the cleaning member 61 to the rear moving end M1 after reaching the front moving end M2, are fallen in the rear concave part 44*b*.

Figure 5:
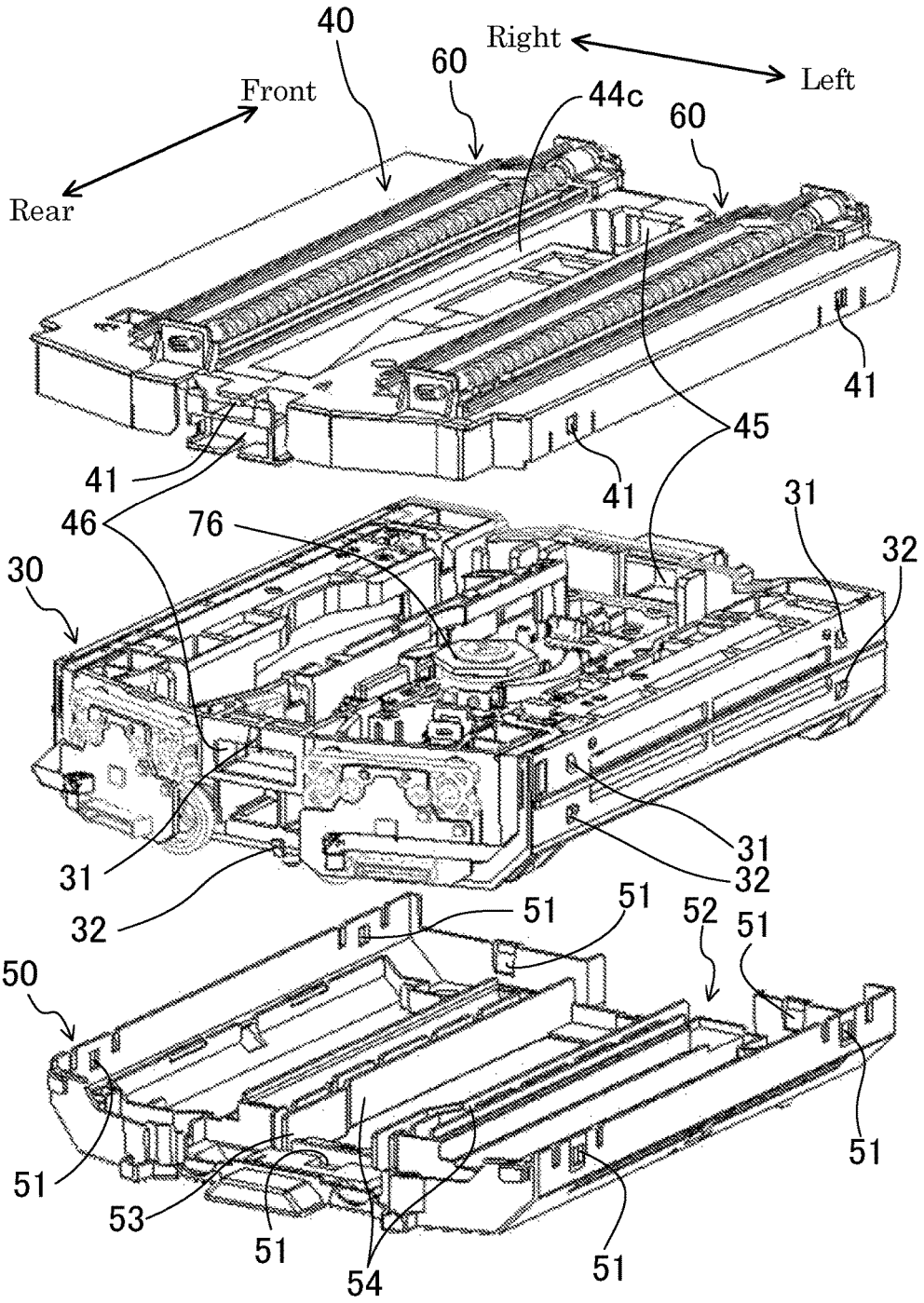
FIG. 5 is an exploded perspective view illustrating a state in which an upper lid and a lower lid have been detached from a housing body.
Figure 6:
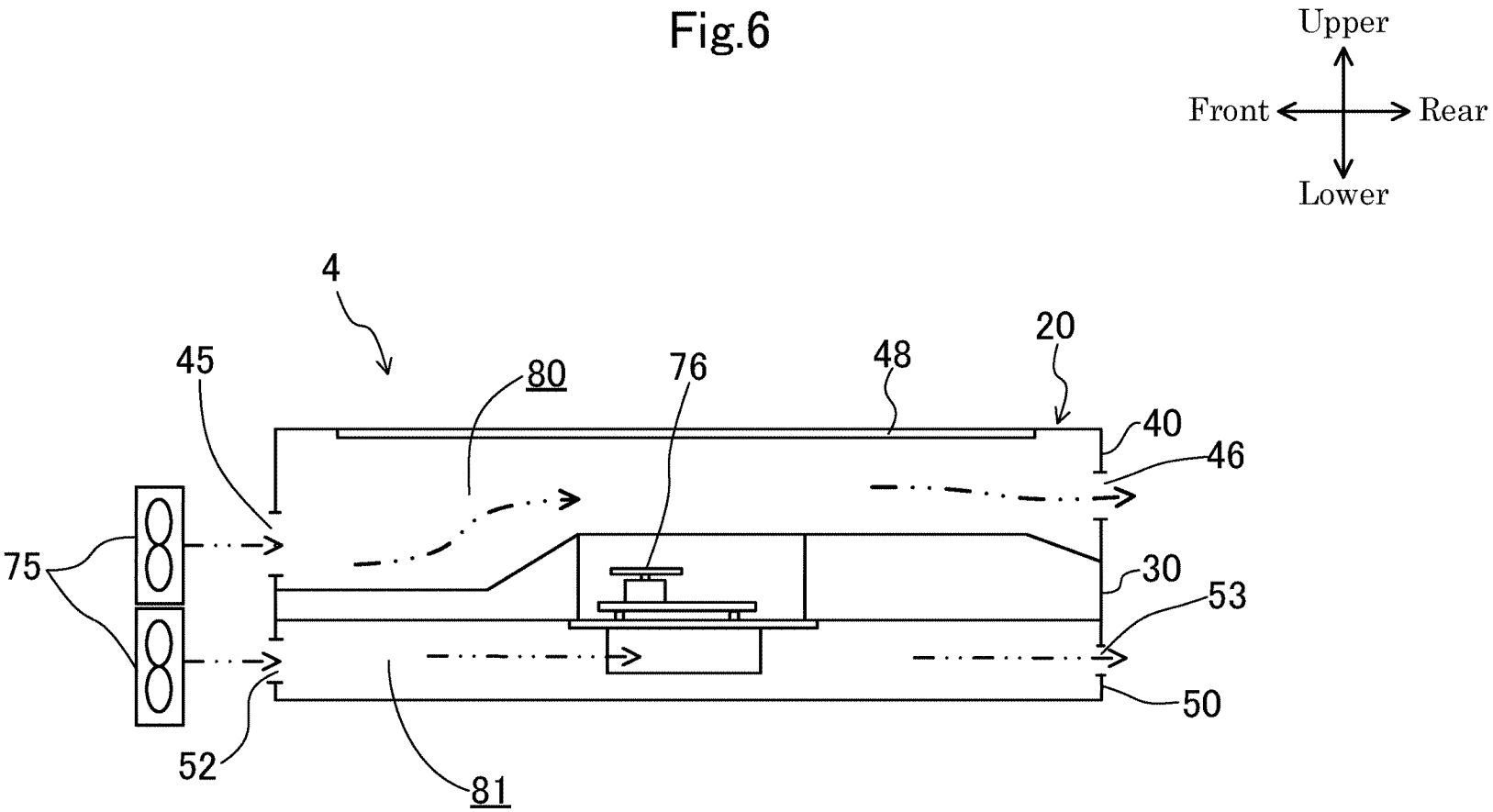
FIG. 6 is a schematic view illustrating a cooling structure in an optical scanning device.

Next, a cooling structure of the optical scanning device 4 will be described with reference to FIG. 5 and FIG. 6. FIG. 5 is an exploded perspective view illustrating the state in which the upper lid 40 and the lower lid 50 have been detached from the housing body 30. The upper lid 40 is fixed to the housing body 30 by allowing engaging holes 41 of sidewall parts thereof to be engaged with engaging projecting parts 31 of the housing body 30. The lower lid 50 is fixed to the housing body 30 by allowing engaging holes 51 of sidewall parts thereof to be engaged with engaging projecting parts 32 of the housing body 30.

The upper lid 40 has a flat rectangular box shape opened downward. At a center part on the upper surface of the upper lid 40 in the right and left direction, a cooling concave part 44*c* is formed to extend over approximately the whole of the center part in the front and rear direction. An upper opening of the cooling concave part 44*c* is closed by a plate-like passage cover 48 extending in the front and rear direction. By the passage cover 48 and an inner wall surface of the cooling concave part 44*c*, an upper cooling air passage 80 (see FIG. 6) extending in the front and rear direction is formed. The passage cover 48 is configured by a seal member capable of improving sealability of the upper cooling air passage 80. The upper cooling air passage 80 communicates with a space in the image forming apparatus body 2 through an air supply port 45 and a discharge port 46. The air supply port 45 passes through a front wall part of the upper lid 40 and a front wall part of the housing body 30. The air supply port 45 is connected to a blowing fan (a blowing part) 75 through a duct (not illustrated). The blowing fan 75 takes airflow outside the housing 20 (outside the image forming apparatus 1 in the present embodiment) into the upper cooling air passage 80 from the supply port 45, and the airflow is discharged through the discharge port 46. In this way, the upper surface part (that is, the inside of the housing 20) of the housing body 30 is cooled by the airflow flowing in the upper cooling air passage 80.

The lower lid 50 has a flat rectangular box shape opened upward. At a center part at the bottom wall part of the lower lid 50 in the right and left direction, a pair of longitudinal wall parts 54 are provided to extend in the front and rear direction. The pair of longitudinal wall parts 54 are arranged spaced apart from each other in the right and left direction. By the pair of longitudinal wall parts 54, the bottom wall part of the lower lid 50, and the bottom wall part of the housing body 30, a lower cooling air passage 81 (see FIG. 6) extending in the front and rear direction is formed. The lower cooling air passage 81 communicates with a space in the image forming apparatus body 2 through an air supply port 52 and a discharge port 53. The air supply port 52 passes through a front wall part of the lower lid 50 and the front wall part of the housing body 30. The air supply port 52 is connected to the blowing fan 75 through a duct (not illustrated), and the lower surface part (that is, the inside of the housing 20) of the housing body 30 is cooled by airflow supplied into the lower cooling air passage 81 by the blowing fan 75.

Figure 7:
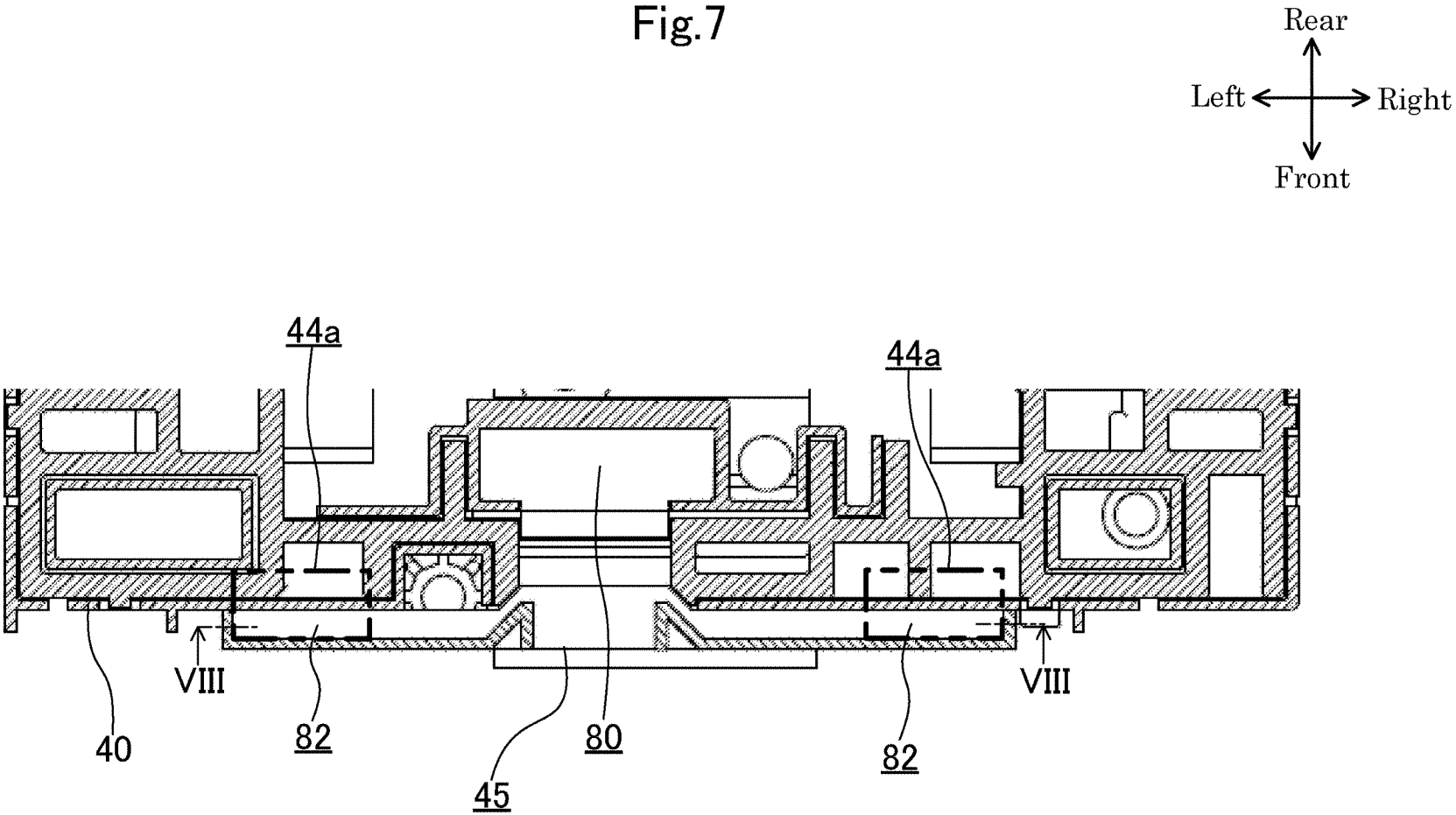
FIG. 7 is a sectional view taken along line VII-VII of FIG. 3.
Figure 8:
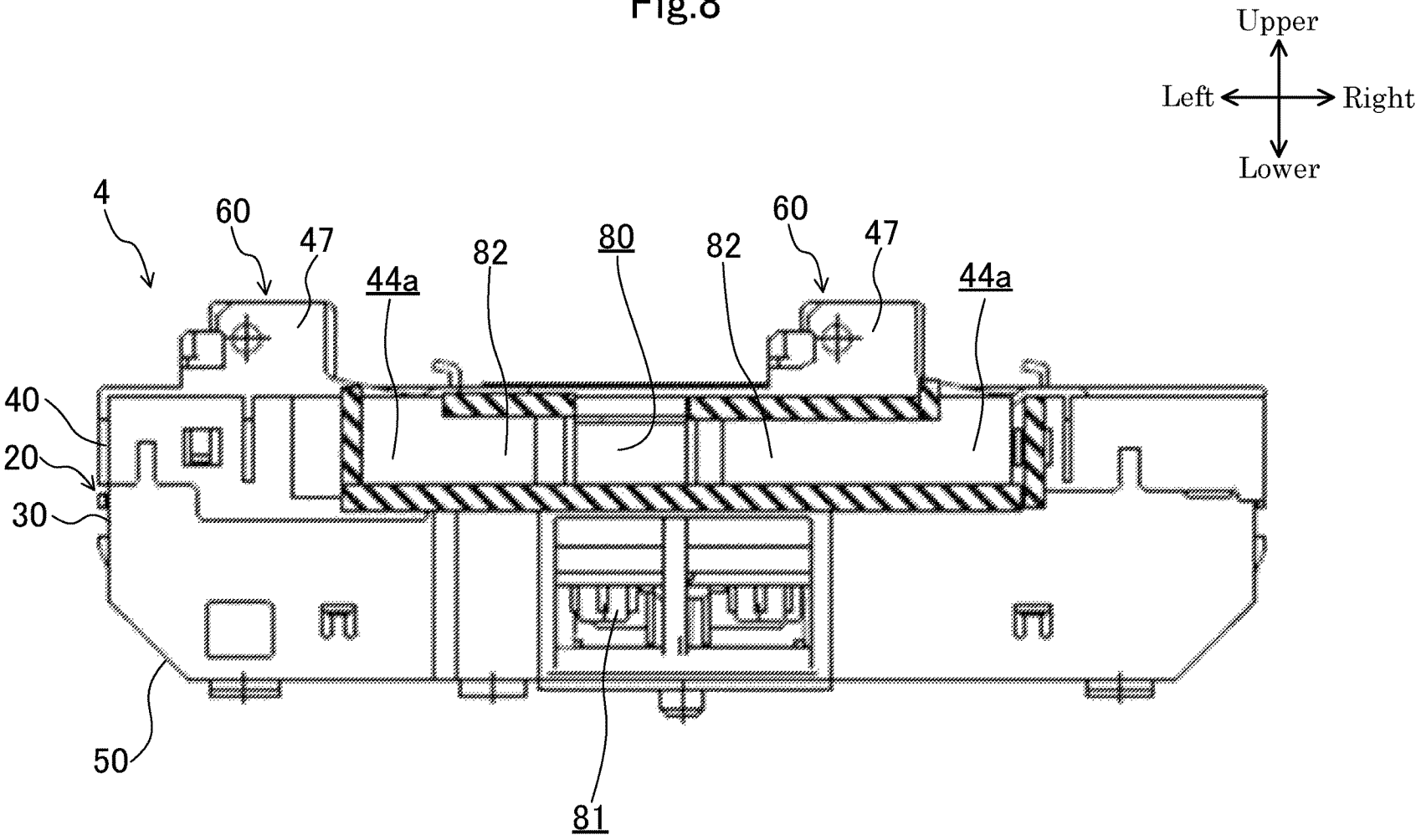
FIG. 8 is a sectional view taken along line VIII-VIII of FIG. 7.

As illustrated in FIG. 7 and FIG. 8, a front end portion (an end portion of the windward side) of the upper cooling air passage 80 communicates with each front concave part 44*a*, which is adjacent to the front side of each glass cover 43, via a communication passage 82. The communication passage 82 is provided only to the front concave part 44*a*, and is not provided to the rear concave part 44*b* (that is, a concave part of the leeward side of the airflow flowing in the upper cooling air passage 80).

Each communication passage 82 has an approximately L shape when viewed from the front side, extends downward from the bottom wall part of the front concave part 44*a*, horizontally extends toward the center part in the right and left direction of the upper lid 40, and then communicates with the upper cooling air passage 80.

Figure 9:
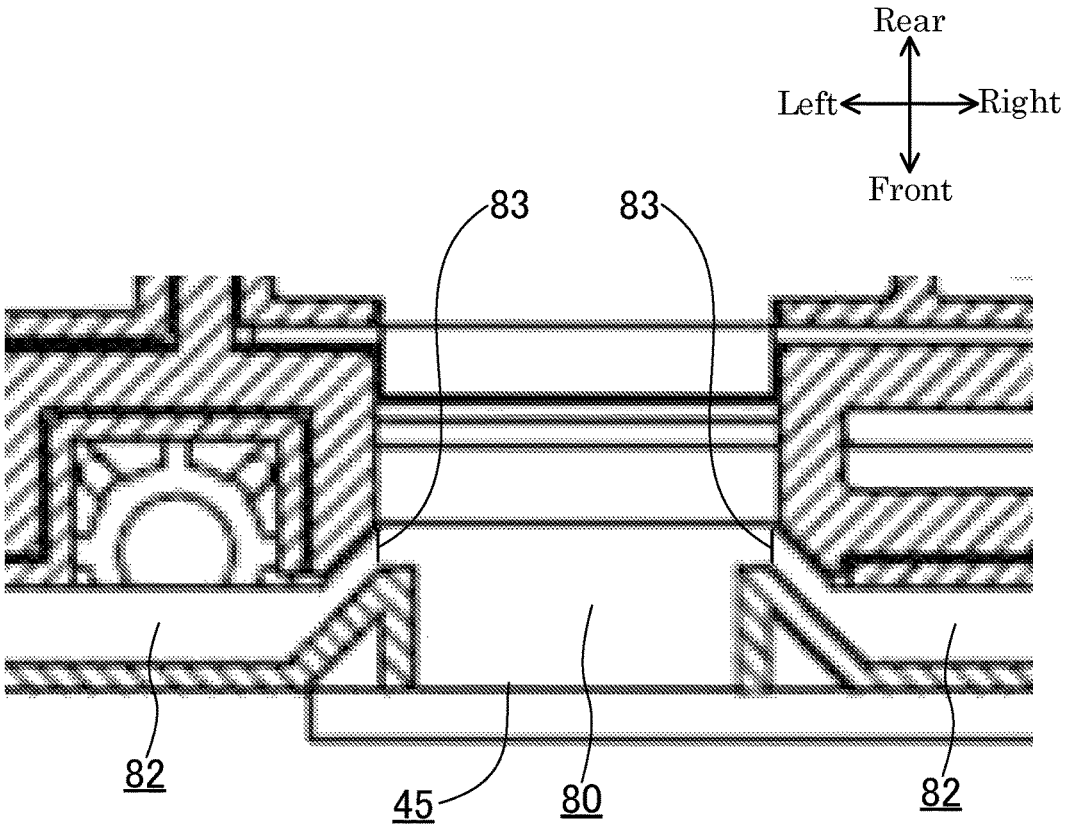
FIG. 9 is an enlarged view illustrating a connection part between an upper cooling air passage and a communication passage in FIG. 8.

As illustrated in FIG. 9, a filter 83 is provided at a connection part between each communication passage 82 and the upper cooling air passage 80. The mesh size of the filter 83 is set to be smaller than an average grain size of foreign matters (toner and the like) collected by the cleaning member 61.

In the aforementioned embodiment, foreign matters on the glass cover 43, which are collected by the cleaning member 61, are fallen in the front concave part 44*a* and the rear concave part 44*b* when the cleaning member 61 has reached the moving ends M1 and M2 of the reciprocal movement path A. Consequently, it is possible to prevent foreign matters from remaining on the glass cover 43.

Moreover, the front concave part 44*a* communicates with the upper cooling air passage 80 via the communication passage 82. Consequently, foreign matters fallen in the front concave part 44*a* are sucked in to the upper cooling air passage 80 side via the communication passage 82 by negative pressure of airflow flowing in the upper cooling air passage 80. Consequently, it is possible to prevent foreign matters from accumulating in the front concave part 44*a*. Accordingly, it is possible to prevent the remaining foreign matters from floating and being reattached to the glass cover 43.

Furthermore, the passage cover 48 covering the upper side of the upper cooling air passage 80 is configured by a seal member, so that it is possible to prevent foreign matters entering into the upper cooling air passage 80 from being discharged outside the air passage from a gap between the passage cover 48 and the upper lid 40 and from fluttering down.

Since most of the foreign matters collected by the cleaning member 61 are fallen in the front concave part 44*a*, the amount of foreign matters fallen in the rear concave part 44*b* is small. That is, since the waiting position of the cleaning member 61 is set at the rear end of the reciprocal movement path A, a large part of foreign matters on the glass cover 43 are collected by a reciprocal operation (that is, a movement operation to the front end from the rear end of the reciprocal movement path A) of the cleaning member 61 and are fallen in the front concave part 44*a*. Consequently, since the amount of foreign matters on the glass cover 43, which are collected by a subsequent reciprocal operation of the cleaning member 61, is small, the amount of foreign matters fallen in the rear concave part 44*b* is considerably smaller than the amount of foreign matters fallen in the front concave part 44*a*. In the aforementioned embodiment, the communication passage 82 is not provided to the rear concave part 44*b* in consideration of this point. In this way, it is possible to prevent a negative pressure effect in the upper cooling air passage 80 from being impaired by unnecessary provision of the communication passage 82. Accordingly, it is possible to prevent a suction effect of foreign matters by the upper cooling air passage 80 from being reduced.

Moreover, the front concave part 44*a* provided with the communication passage 82 is positioned at the windward side of cooling air, that is, at a side at which the blowing fan 75 is positioned. Consequently, it is possible to improve the suction effect of foreign matters because pressure loss of the cooling air is small as compared with the case in which the communication passage 82 is provided at the leeward side of the cooling air.

Furthermore, in the aforementioned embodiment, the filter is provided at the connection part between the upper cooling air passage 80 and the communication passage 82 to capture foreign matters passing through the communication passage 82 and included in the air. Consequently, it is possible to prevent foreign matters flowing in the upper cooling air passage 80 and moving with airflow from being discharged to the outside of the optical scanning device 4. Consequently, the inside of the image forming apparatus 1 is not contaminated by discharged foreign matters.

<<Modification Example>>

Figure 10:
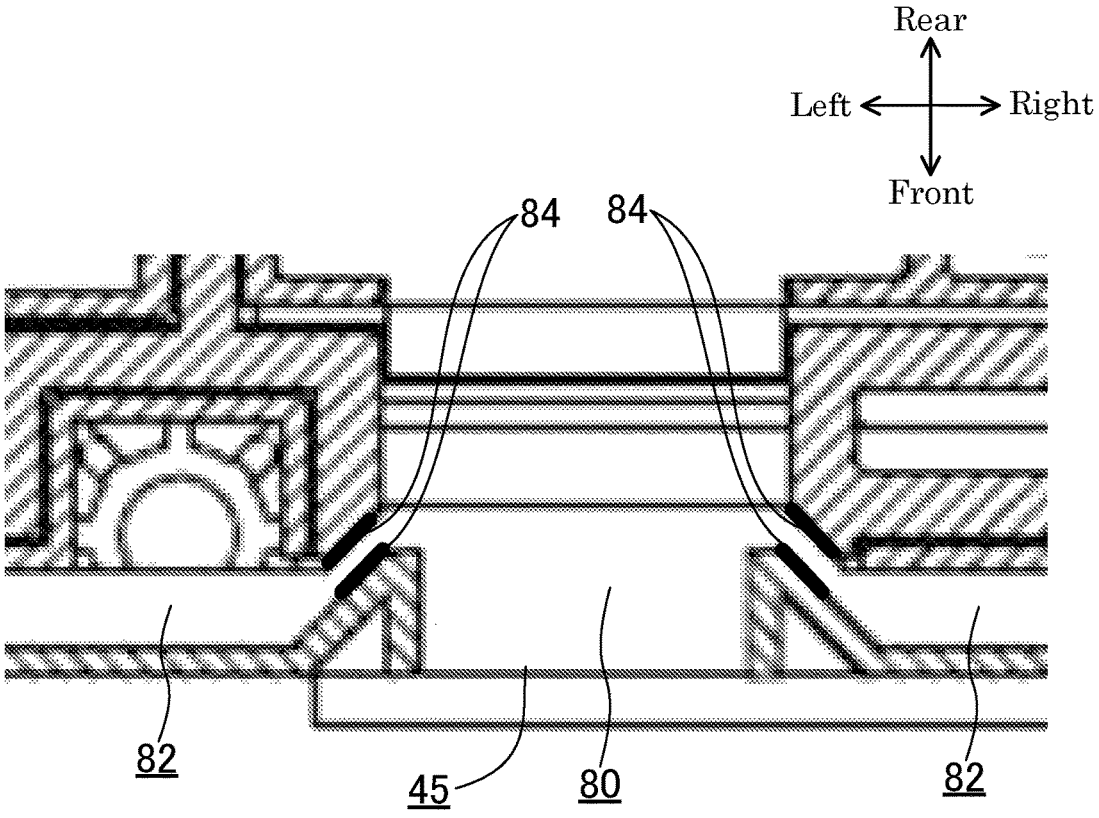
FIG. 10 is a view corresponding to FIG. 9, which illustrates a modification example.

FIG. 10 illustrates a modification example of the aforementioned embodiment. In this modification example, the filter 83 at the connection part between the upper cooling air passage 80 and the communication passage 82 is removed and a double sided tape 84 is provided. The double sided tape 84 is stuck to the wall surface of the connection part. In this way, it is possible to adhere foreign matters in the air, which passes through the connection part, by the double sided tape 84. According to this configuration, it is not necessary to block airflow of the connection part as with the case in which the filter 83 is provided, so that it is possible to reduce pressure loss at the connection part. Thus, it is possible to improve the suction effect of foreign matters to the upper cooling air passage 80 as compared with the aforementioned embodiment.

<<Other Embodiments>>

In the aforementioned embodiment, the communication passage 82 is provided only to the front concave part 44*a*; however, the technology of the present disclosure is not limited thereto and the communication passage 82 may also be provided to both the front concave part 44*a* and the rear concave part 44*b*.

In the aforementioned embodiment, the front concave part 44*a* and the rear concave part 44*b* are formed at both front and rear sides of each glass cover 43; however, the technology of the present disclosure is not limited thereto and for example, the rear concave part 44*b* may be removed and only the front concave part 44*a* may also be provided. In this way, it is possible to miniaturize the optical scanning device 4.

As described above, the technology of the present disclosure is useful for an optical scanning device and an image forming apparatus including the same.

What is claimed is:

1. An optical scanning device including a housing having a light emitting port extending in a predetermined direction, a transparent cover extending in the predetermined direction to close the light emitting port, a freely rotatable screw shaft arranged along the transparent cover and formed on a peripheral surface thereof with a spiral groove, a holding member engaged with the screw shaft and moving along a predetermined reciprocal movement path according to rotation of the screw shaft, and a cleaning member held by the holding member and cleaning a surface of the transparent cover while moving in the predetermined direction according to reciprocal movement of the holding member, comprising:

a cooling air passage that passes through inside of the housing;

a blowing part that takes in air outside of the housing from a first end portion of the cooling air passage and allowing the air to be discharged from a second side portion, the first end portion facing the second side portion;

a foreign matter falling concave part provided adjacent to the transparent cover in the predetermined direction such that an accumulated foreign matter is fallen at a front side in a progress direction of the cleaning member when the cleaning member reaches each moving end of the reciprocal movement path; and a communication passage that allows the foreign matter falling concave part and the cooling air passage to communicate with each other, wherein the foreign matter falling concave part is a concave part which is opened upward and formed on an upper surface of the housing, one end of the communication passage opens to an inner wall surface of the foreign matter falling concave part, and the other end of the communication passage opens to an inner wall surface of the cooling air passage.

2. The optical scanning device of claim 1, wherein a connection part between the cooling air passage and the communication passage is provided with a filter for capturing a foreign matter included in air passing through the communication passage or a double sided tape for adhering the foreign matter included in the air.

3. The optical scanning device of claim 1, wherein the cooling air passage is configured to extend in the housing in the predetermined direction and to allow the air taken in by the blowing part to flow in the predetermined direction, and the foreign matter falling concave part is provided only at a windward side of both sides of the transparent cover in the predetermined direction.

4. The optical scanning device of claim 3, wherein one moving end of the reciprocal movement path of the cleaning member serves as a waiting position at which the cleaning member having ended a reciprocal operation waits until a subsequent reciprocal operation starts, and the waiting position is set at an opposite side of the windward side of the reciprocal movement path in the predetermined direction.

5. An image forming apparatus including the optical scanning device of claim 1.

6. The optical scanning device of claim 1, wherein the one end of the communication passage communicates with the bottom wall part of the inner wall surface of the foreign matter falling concave part.

7. An optical scanning device including a housing having a light emitting port extending in a predetermined direction, a transparent cover extending in the predetermined direction to close the light emitting port, a freely rotatable screw shaft arranged along the transparent cover and formed on a peripheral surface thereof with a spiral groove, a holding member engaged with the screw shaft and moving along a predetermined reciprocal movement path according to rotation of the screw shaft, and a cleaning member held by the holding member and cleaning a surface of the transparent cover while moving in the predetermined direction according to reciprocal movement of the holding member, comprising:

a cooling air passage that passes through inside of the housing;

a blowing part that takes in air outside of the housing from a first end portion of the cooling air passage and allowing the air to be discharged from a second side portion, the first end portion facing the second side portion;

a foreign matter falling concave part provided adjacent to the transparent cover in the predetermined direction such that an accumulated foreign matter is fallen at a front side in a progress direction of the cleaning member when the cleaning member reaches each moving end of the reciprocal movement path; and a communication passage that allows the foreign matter falling concave part and the cooling air passage to communicate with each other, wherein a connection part between the cooling air passage and the communication passage is provided with a filter for capturing a foreign matter included in air passing through the communication passage or a double sided tape for adhering the foreign matter included in the air.

8. The optical scanning device of claim 7, wherein the cooling air passage is configured to extend in the housing in the predetermined direction and to allow the air taken in by the blowing part to flow in the predetermined direction, and the foreign matter falling concave part is provided only at a windward side of both sides of the transparent cover in the predetermined direction.

9. The optical scanning device of claim 8, wherein one moving end of the reciprocal movement path of the cleaning member serves as a waiting position at which the cleaning member having ended a reciprocal operation waits until a subsequent reciprocal operation starts, and the waiting position is set at an opposite side of the windward side of the reciprocal movement path in the predetermined direction.

10. An image forming apparatus including the optical scanning device of claim 7.

* * * * *